US011802455B2

(12) United States Patent
Neveu et al.

(10) Patent No.: US 11,802,455 B2
(45) Date of Patent: Oct. 31, 2023

(54) EXPANDABLE METAL PACKER WITH ANCHORING SYSTEM

(71) Applicant: Saltel Industries, Bruz (FR)

(72) Inventors: Romain Neveu, Bruz (FR); Samuel Roselier, Bruz (FR); Gwenael Tanguy, Bruz (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 235 days.

(21) Appl. No.: 17/423,288

(22) PCT Filed: Jan. 23, 2020

(86) PCT No.: PCT/EP2020/051609
§ 371 (c)(1),
(2) Date: Jul. 15, 2021

(87) PCT Pub. No.: WO2020/152260
PCT Pub. Date: Jul. 30, 2020

(65) Prior Publication Data

US 2022/0090459 A1 Mar. 24, 2022

(30) Foreign Application Priority Data

Jan. 23, 2019 (EP) ..... 19305084

(51) Int. Cl.
*E21B 23/06* (2006.01)
*E21B 33/12* (2006.01)
*E21B 33/127* (2006.01)

(52) U.S. Cl.
CPC ..... *E21B 23/06* (2013.01); *E21B 33/1208* (2013.01); *E21B 33/127* (2013.01)

(58) Field of Classification Search
CPC .... E21B 23/06; E21B 33/1208; E21B 33/127; E21B 23/04; E21B 33/128; E21B 23/01
See application file for complete search history.

(56) References Cited

U.S. PATENT DOCUMENTS 9,816,344 B2 * 11/2017 Roselier ..... E21B 33/10
2006/0042801 A1 3/2006 Hackworth et al.
(Continued)

FOREIGN PATENT DOCUMENTS

EP 2206879 A1 7/2010
EP 3216976 A1 9/2017
(Continued)

OTHER PUBLICATIONS

International Search Report and Written Opinion issued in the PCT Application PCT/EP2020/051609, dated Mar. 18, 2020 (14 pages).
(Continued)

*Primary Examiner* — Steven A Macdonald
(74) *Attorney, Agent, or Firm* — Michael Wills, III

(57) ABSTRACT

A technique facilitates use of a packer (34) in a borehole (32) or within other tubular structures. The packer (34) may be constructed for mounting about a generally tubular base pipe (36). The packer (34) generally comprises a metal sleeve (40) combined with extremities (44) located at each axial end of the metal sleeve. The metal sleeve maintains a seal once expanded to a surrounding wellbore wall, e.g. a casing wall. For example, the metal sleeve may be combined with an elastomer along its exterior so the elastomer may seal against the surrounding wellbore wall (42) when the metal sleeve is radially expanded. Additionally, an anchoring system (48) is disposed within one or both of the extremities and oriented for engagement with the tubular base pipe so as to act against rotation and sliding of the packer with respect to the tubular base pipe (42).

9 Claims, 9 Drawing Sheets

(56) References Cited

U.S. PATENT DOCUMENTS

| | | | | |
|---|---|---|---|---|
| 2014/0196887 | A1* | 7/2014 | Hallundaek | E21B 33/1277 166/179 |
| 2014/0216755 | A1* | 8/2014 | Hallundaek | E21B 33/1243 166/387 |
| 2015/0075818 | A1* | 3/2015 | Roselier | E21B 17/07 166/387 |
| 2016/0097254 | A1 | 4/2016 | Wood et al. | |
| 2016/0222753 | A1* | 8/2016 | Massey | E21B 23/065 |
| 2017/0101847 | A1* | 4/2017 | Hazel | E21B 43/103 |
| 2017/0370179 | A1* | 12/2017 | Vasques | E21B 47/06 |
| 2020/0165892 | A1* | 5/2020 | Vasques | E21B 33/128 |
| 2020/0248530 | A1* | 8/2020 | Kumar | E21B 34/10 |

FOREIGN PATENT DOCUMENTS

| | | | |
|---|---|---|---|
| WO | 2013152940 | A1 | 10/2013 |
| WO | 2014003576 | A2 | 1/2014 |
| WO | 2016135258 | A1 | 9/2016 |

OTHER PUBLICATIONS

Substantive Exam issued in Saudi Arabia Patent Application No. 521422582 dated Jun. 30, 2023, 16 pages with English translation.

* cited by examiner

EXPANDABLE METAL PACKER WITH ANCHORING SYSTEM

BACKGROUND

In many well applications, packers are used to seal off sections of a wellbore. The packers are delivered downhole via a well string and then set against the surrounding wellbore surface to provide annular barriers between the adjacent uphole and downhole sections of wellbore. In various applications, each packer comprises an elastomeric element which may be expanded radially into sealing engagement with the surrounding borehole surface. Additionally, some applications utilize an expandable metal packer or packers mounted along a base pipe of the well string. Such expandable metal packers use a deformable metal membrane which is deformed permanently by the pressure of inflating fluid. However, the coupling between the packer and the base pipe may be susceptible to undesirable sliding or rotation of the packer with respect to the base pipe.

SUMMARY

In general, a system and methodology are provided for utilizing a packer in a borehole or within other tubular structures. The packer may be constructed for mounting about a generally tubular base pipe. The packer generally comprises a metal sleeve combined with extremities located at each axial end of the metal sleeve. The metal sleeve maintains a seal once expanded to a surrounding wellbore wall, e.g. a casing wall. For example, the metal sleeve may be combined with an elastomer along its exterior, the elastomer sealing against the surrounding wellbore wall when the metal sleeve is radially expanded. Additionally, an anchoring system is disposed within one or both of the extremities and oriented for engagement with the tubular base pipe so as to act against rotation and sliding of the packer with respect to the tubular base pipe.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for utilizing a packer in a borehole or within other tubular structures. For example, one or more of the packers may be deployed downhole into a wellbore via a well string. The packer or packers may then be actuated to a set position to form a seal with the surrounding wellbore surface, e.g. an interior casing surface or an open hole surface, and to isolate sections of the annulus along the well string.

By way of example, the packer may be an expandable metal packer constructed with a metal sealing element. The metal sealing element may be mounted around a base pipe which may be part of a well string, e.g. a drilling string, or other tubing string. When the packer is positioned at a desired location within the borehole or other tubular structure, the metal sealing element may be expanded under fluid pressure for sealing engagement with a surrounding wall surface. For example, the metal sealing element may be a permanently deformable metal bladder, e.g. a metal membrane, which is deformed downhole via the fluid pressure, e.g. hydroforming.

According to an embodiment, a system and methodology are provided for utilizing a packer in a borehole or within other tubular structures. The packer may be constructed for mounting about a generally tubular base pipe. In general, the packer comprises a metal sleeve combined with extremities located at each axial end of the metal sleeve. The metal sleeve maintains a seal once expanded to a surrounding wellbore wall, e.g. a casing wall. For example, the metal sleeve may be combined with an elastomer along its exterior. The elastomer may be a single piece or a plurality of pieces positioned to seal against the surrounding wellbore wall when the metal sleeve is radially expanded. Additionally, an anchoring system is disposed within one or both of the extremities and oriented for engagement with the tubular base pipe so as to act against rotation and sliding of the packer with respect to the tubular base pipe.

As described in greater detail below, the packer may be fixed in both axial and rotational directions on a variety of tubular base pipes. The anchoring system enables the packer to hold against high torque that may occur between the packer and the base pipe. Consequently, the packer may be used in various types of well applications which can incur torque loads. An example of a suitable application is a casing while drilling application. In such an application, the packer or packers may be mounted as part of a drill string to perform a stage cementing operation.

Figure 1:
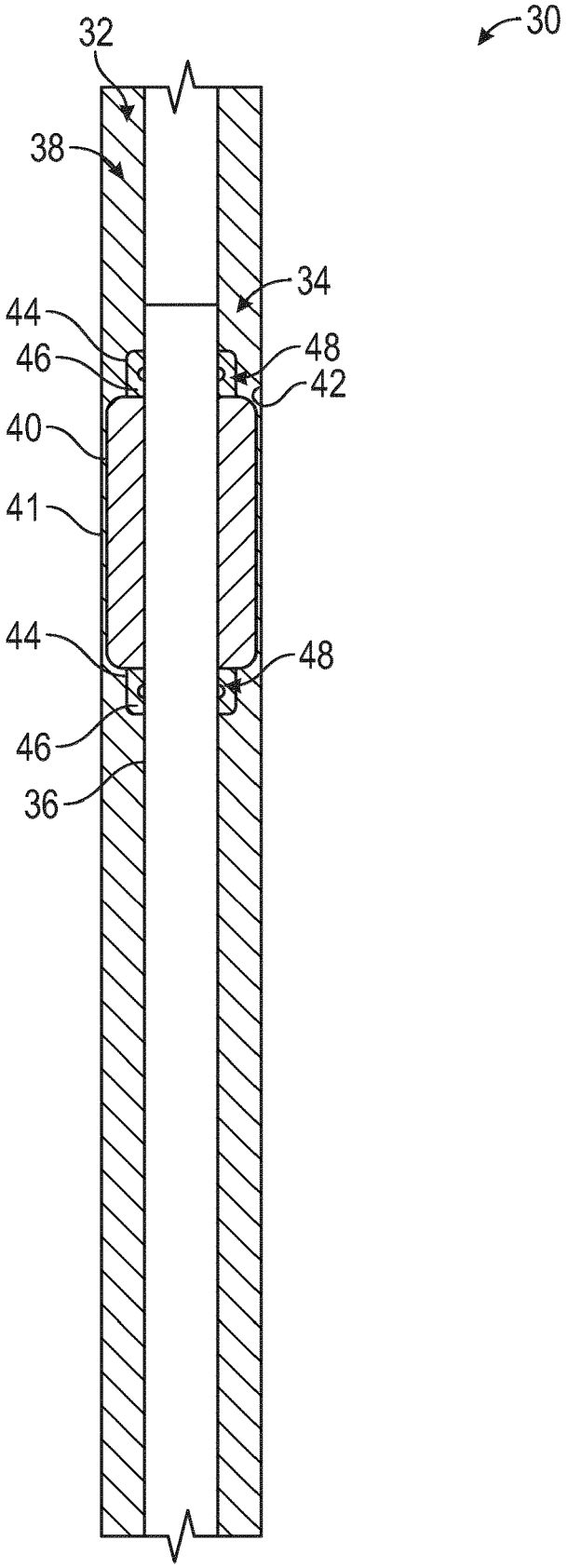
FIG. 1 is an illustration of an example of an expandable metal packer mounted along a tubing string in a borehole, according to an embodiment of the disclosure.
Figure 2:
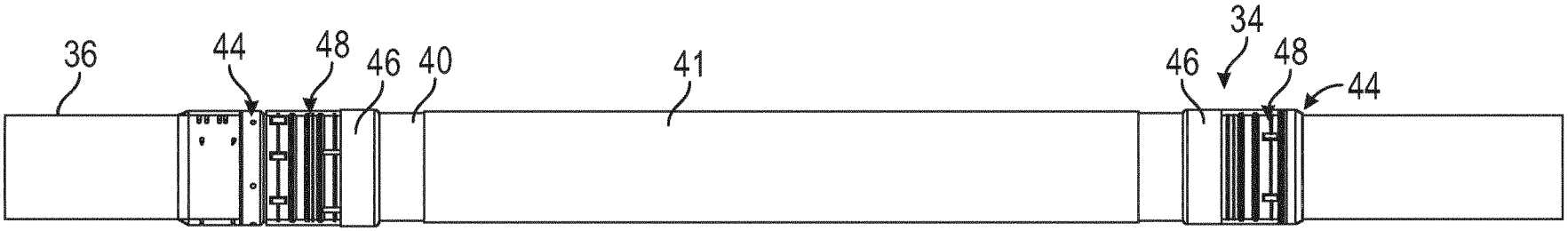
FIG. 2 is a front view of an example of an expandable metal packer positioned along a tubing, according to an embodiment of the disclosure.

Referring generally to FIG. 1, an example of a well system 30 is illustrated as deployed in a borehole 32, e.g. a wellbore. The well system 30 comprises an expandable metal packer 34 mounted along a base pipe 36 which may be part of an overall tubing string 38, e.g. a well production or casing string. With additional reference to FIG. 2, the packer 34 may comprise an expandable metal sleeve 40 combined with a sealing element(s) 41, e.g. an elastomeric sealing element. The metal sleeve 40 maintains a seal once expanded to a surrounding borehole wall surface 42, e.g. a casing wall or open hole wellbore wall surface. For example, the elastomeric sealing element 41 may be positioned along an exterior of the metal sleeve 40 so as to seal against the surrounding wellbore wall surface 42 when the metal sleeve 40 is radially expanded outwardly to the wall surface 42.

The expandable metal sleeve 40 is disposed between extremities 44. For example, the extremities 44 may be coupled with the expandable metal sleeve 40 and positioned with one extremity 44 on each axial end of the expandable metal sleeve 40. Each extremity 44 may comprise a metal collar 46 positioned around the base pipe 36. During mounting of packer 34 along tubing string 38, the metal collars 46 may be plastically deformed, e.g. crimped, to secure the packer 34 to the base pipe 36.

The packer 34 further comprises an anchoring system 48 positioned between at least one of the extremities 44 and the base pipe 36 to prevent both axial sliding and rotation of the expandable metal packer 34 relative to the base pipe 36. In the example illustrated, the anchoring system 48 operates between each of the extremities 44 and the base pipe 36. As described in greater detail below, the anchoring system 48 may utilize various features to create interference between the packer 34 and the base pipe 36 so as to prevent relative rotation even under high torque loads.

Depending on the application, the expandable metal sleeve 40 may comprise a metal membrane, e.g. a bladder, or other metal structure which may be plastically deformed into a permanent expanded structure engaging the surrounding wall surface 42. In some embodiments, the metal sleeve 40 is expanded via fluid pressure, e.g. via a hydroforming process. For example, high pressure fluid may be delivered along an interior of tubing string 38 and directed into an interior of the expandable metal sleeve 40 via a passage or passages extending through a wall of base pipe 36.

Figure 3:
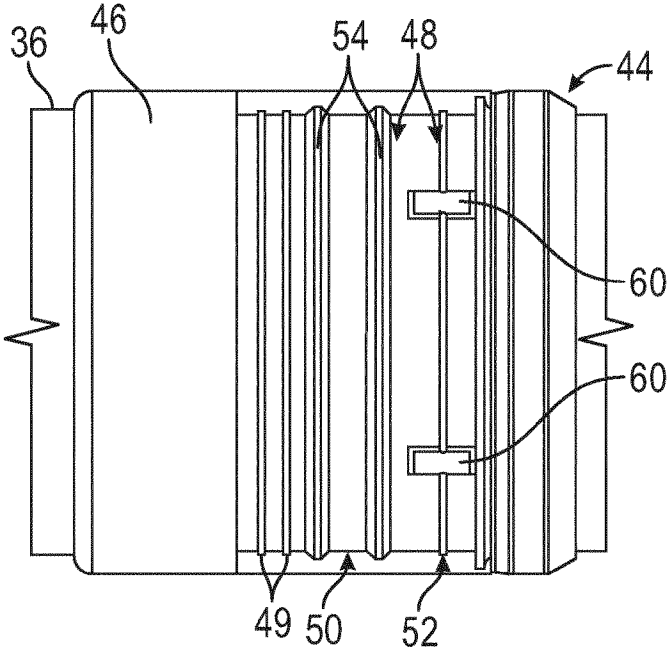
FIG. 3 is a front view of an example of a packer extremity combined with an anchoring system and located at an end of an expandable metal sleeve, according to an embodiment of the disclosure.
Figure 4:
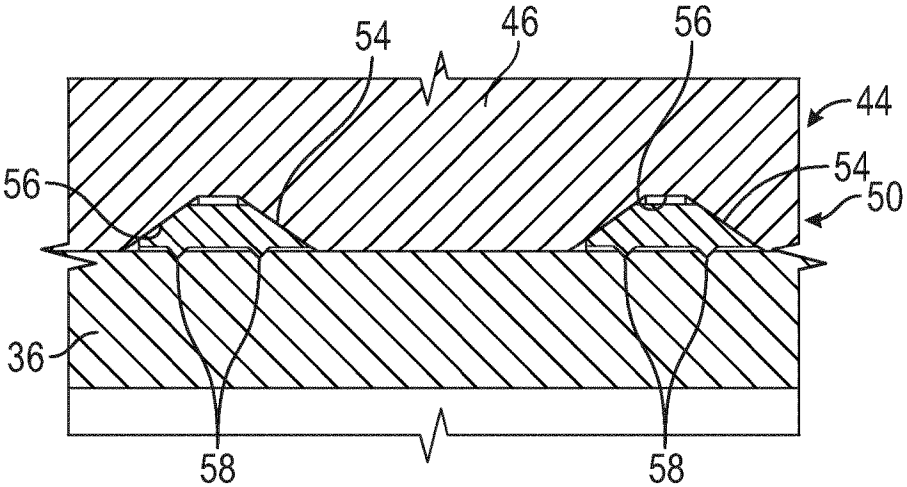
FIG. 4 is a cross-sectional illustration showing features of the anchoring system illustrated in FIG. 2, according to an embodiment of the disclosure.
Figure 5:
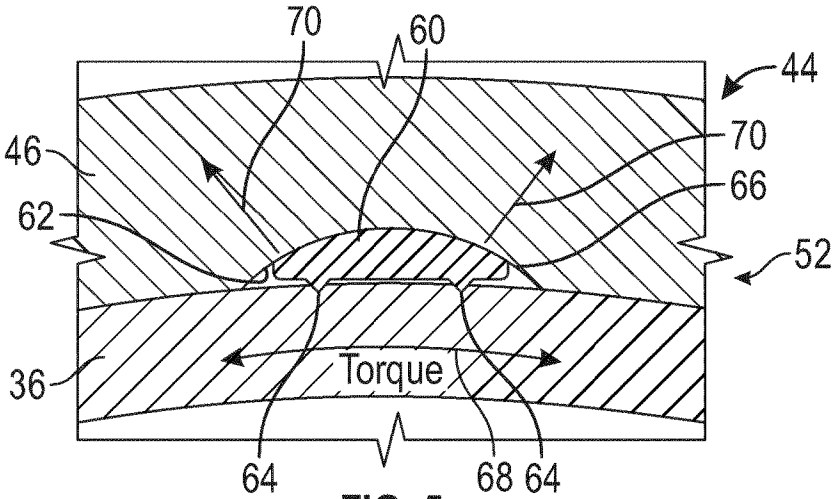
FIG. 5 is a cross-sectional illustration showing additional features of the anchoring system illustrated in FIG. 2, according to an embodiment of the disclosure.

Referring generally to FIGS. 3-5, an embodiment of the anchoring system 48 is illustrated. In this example, the anchoring system 48 may comprise seals 49 and an axial mechanism 50 to prevent relative movement between packer 34 and base pipe 36 in the axial direction. The anchoring system 48 also may comprise a separate rotational mechanism 52 to prevent relative rotational movement between packer 34 and base pipe 36.

The axial mechanism 50 comprises at least one axial movement prevention ring 54, e.g. a plurality of rings 54. The rings 54 may be located in corresponding grooves 56 formed in collar 46 of the corresponding extremity 44. It should be noted the axial mechanism 50 and rotational mechanism 52 may be employed in each of the extremities 44.

As illustrated in FIG. 4, the rings 54 also have gripping features 58 oriented toward the base pipe 36 for engagement with the base pipe 36. The location of rings 54 and corresponding grooves 56 and the gripping engagement with base pipe 36 via features 58 create an interference between the collar 46 and the base pipe 36. This interference prevents linear or axial movement of the packer 34 with respect to the base pipe 36.

With additional reference to FIG. 5, the rotational mechanism 52 comprises at least one pad 60, e.g. a plurality of pads, disposed between the collar 46 and the base pipe 36. For example, the plurality of pads 60 may be positioned within corresponding recesses 62 formed in collar 46 of the corresponding extremity 44. The pads 60 each have a gripping side with rotational gripping features 64 oriented toward the base pipe 36 for engagement with the base pipe 36. Each pad 60 also has a curved side 66 disposed in the corresponding recess 62 and oriented against the corresponding collar 46/extremity 44.

When a torque, as represented by arrow 68, is applied to the base pipe 36, the corresponding curved side 66 of each pad 60 wedges against the corresponding curved side of recess 62 to create a load as represented by arrows 70 (load side depends on the direction of the applied torque). The pads 60 effectively create interference via the wedge effect to prevent rotational motion of the packer 34 with respect to the base pipe 36.

Figure 8:
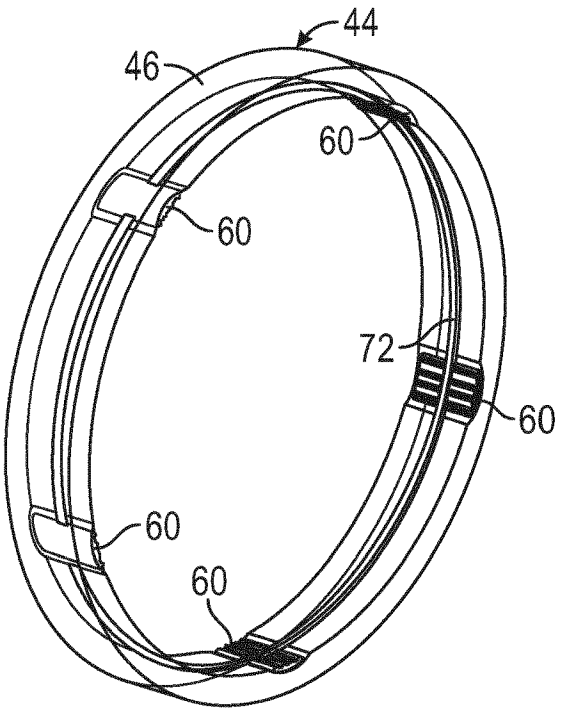
FIG. 8 is an illustration showing an example of a retention member for retaining the pads in recesses within the corresponding extremity, according to an embodiment of the disclosure.
Figure 7:
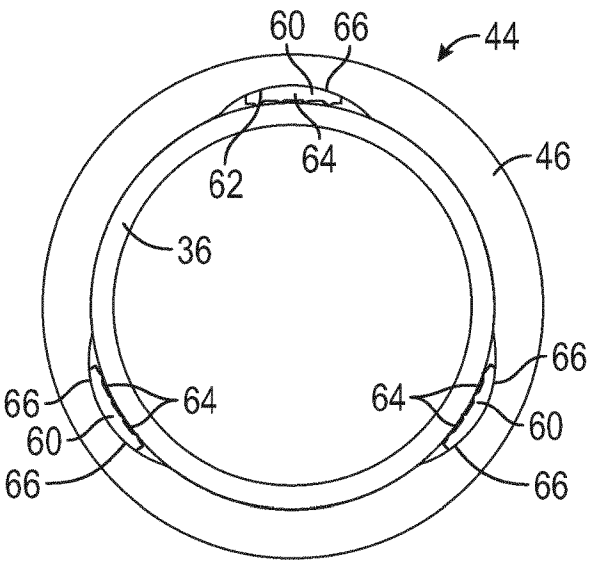
FIG. 7 is a cross-sectional illustration similar to that of FIG. 6 but showing the corresponding extremity in a plastically deformed condition trapping the pads between the extremity and the internal base pipe, according to an embodiment of the disclosure.
Figure 6:
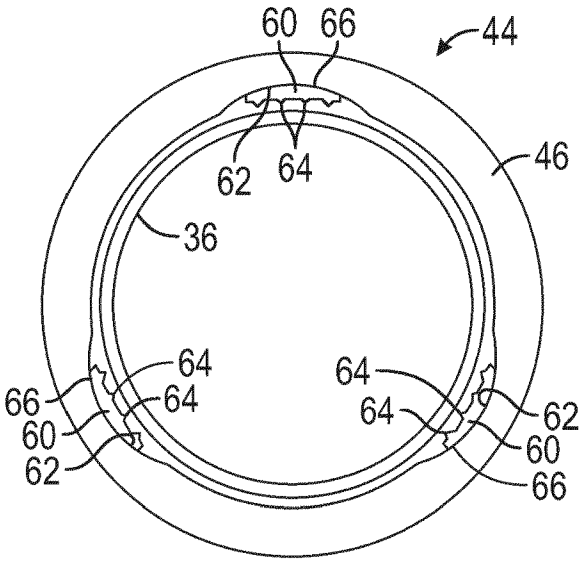
FIG. 6 is a cross-sectional illustration showing examples of pads oriented for prevention of relative rotation between the packer and the base pipe, according to an embodiment of the disclosure.

When packer 34 is mounted to base pipe 36 at a desired location, the collars 46 may initially be in an expanded configuration, as illustrated in FIG. 6. Once the packer 34 is located at the desired position along base pipe 36 and tubing string 38, the extremities 44 are plastically deformed in a radially inward direction to reduce their diameters. For example, the extremities 44 may be crimped so the collars 46 plastically deform in a radially inward direction until a desired reduction in diameter occurs. The plastic deformation is applied sufficiently to squeeze the pads 60 between the base pipe 36 and the corresponding collars 46, as illustrated in FIG. 7. As illustrated in FIG. 8, a retention member 72, e.g. a spring or a split ring, may be used to initially maintain the pads 60 in their corresponding recesses 62 prior to the plastic deformation. In some embodiments, the pads 60 may be glued or otherwise suitably maintained in their recesses 62. Once plastically deformed, the anchoring system 48 prevents both axial movement and rotational movement of the packer 34 relative to the base pipe 36.

Figure 10:
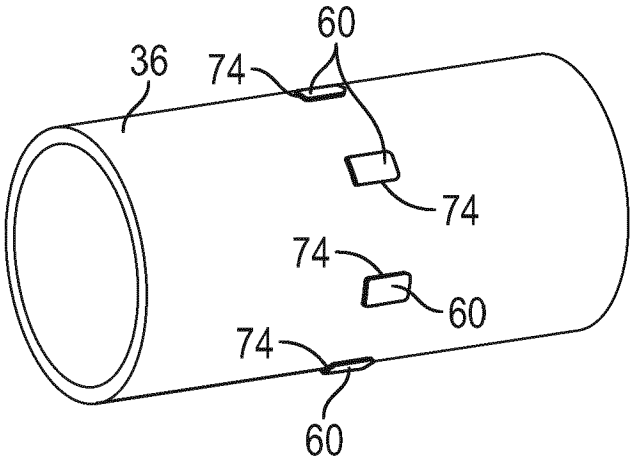
FIG. 10 is an illustration of an example of the base pipe having pads of the anchoring system placed in the recesses illustrated in FIG. 9, according to an embodiment of the disclosure.
Figure 9:
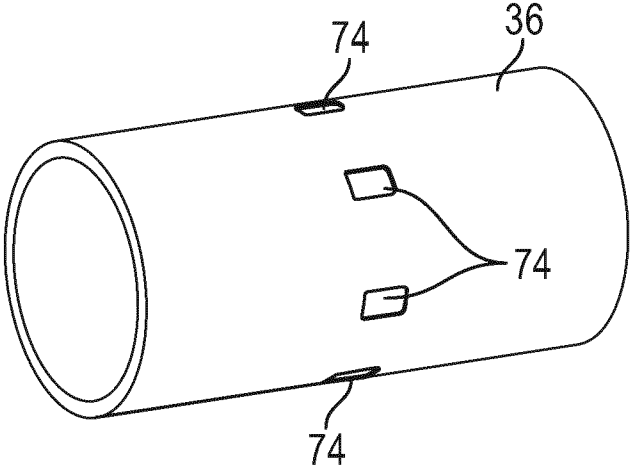
FIG. 9 is an illustration of an example of a base pipe having recesses positioned for receiving pads of the anchoring system, according to an embodiment of the disclosure.
Figure 11:
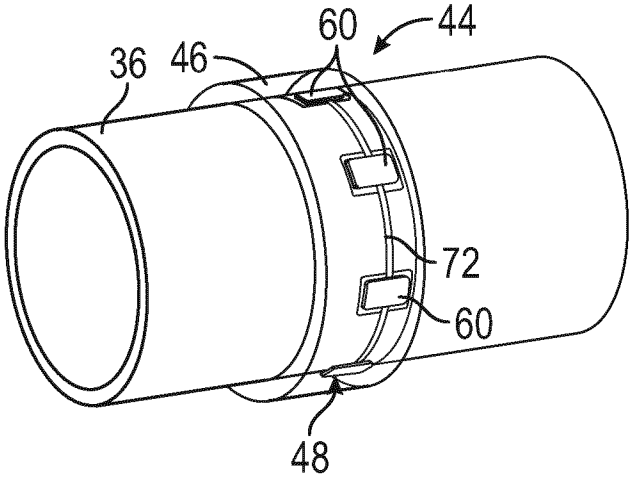
FIG. 11 is an illustration of the corresponding extremity slid over the base pipe and pads illustrated in FIG. 10, according to an embodiment of the disclosure.

According to another embodiment, additional recesses 74 also may be formed in base pipe 36 as illustrated in FIG. 9. The additional recesses 74 are sized and located for receiving pads 60, as illustrated in FIG. 10. In this type of embodiment, the pads 60 may initially be located on base pipe 36 and then the corresponding extremity 44 may be slid over the pads 60 as illustrated in FIG. 11. The collar 46 of the corresponding extremity 44 may then be crimped or otherwise plastically deformed to secure the pads 60 between the extremity 44 and the base pipe 36. In some embodiments, a suitable retention member 72 may be used to initially secure pads 60 in the additional recesses 74 formed along base pipe 36.

Figure 12:
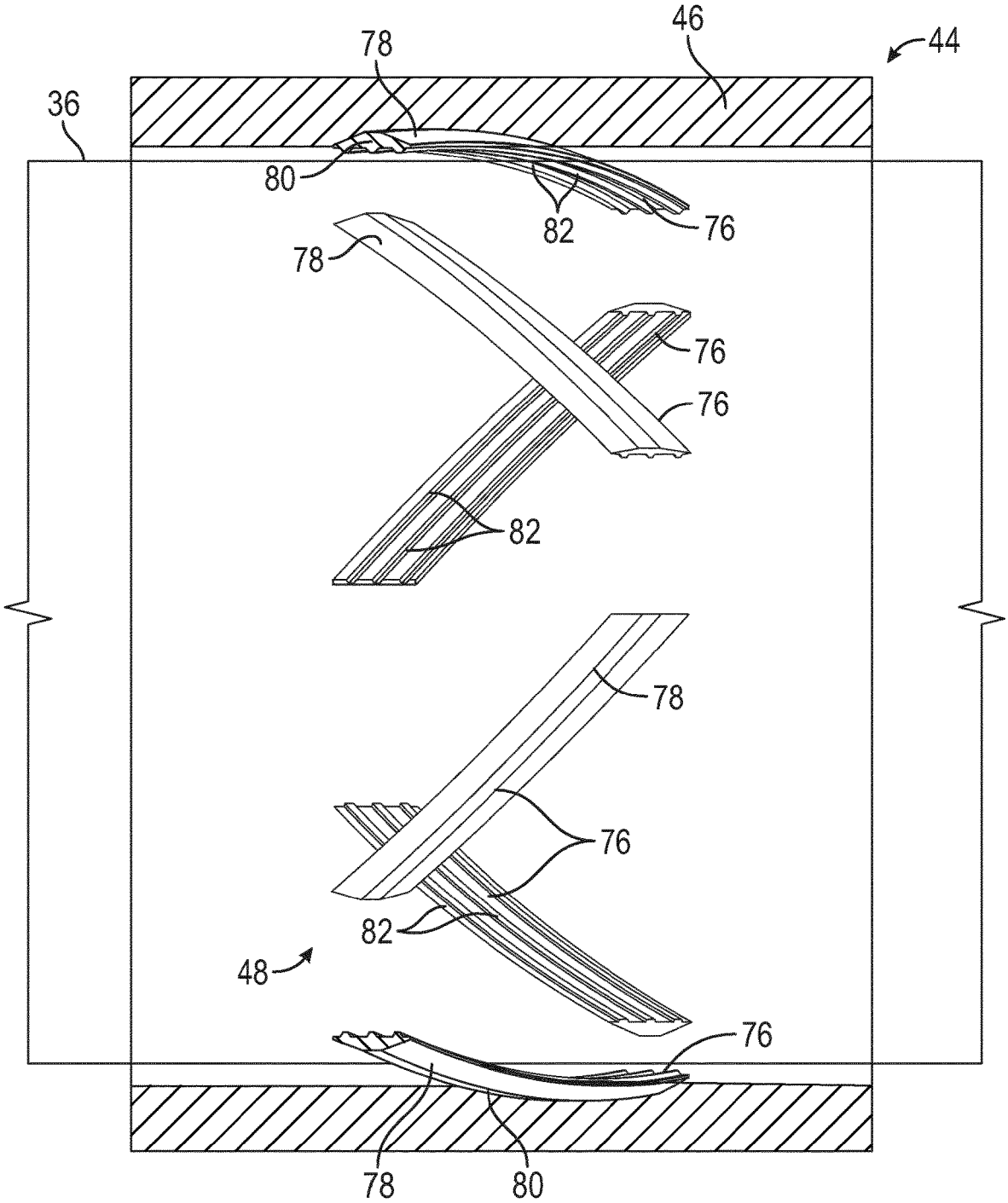
FIG. 12 is an illustration of another example of the anchoring system disposed within a corresponding extremity, according to an embodiment of the disclosure.

Referring generally to FIG. 12, another embodiment of anchoring system 48 is illustrated. In this example, the anchoring system 48 comprises a plurality of wedge members 76 which are arranged between the collar 46 and the base pipe 36 at one or both of the extremities 44. By way of example, the wedge members 76 may be arranged in a helical pattern between each extremity 44 and the base pipe 36. In some embodiments, each wedge member 76 may have a generally helicoidal shape and may be oriented helically about the interior of the corresponding collar 46. Because of the helical orientation, the wedge members 76 serve as both axial mechanism 50 and rotational mechanism 52 to prevent relative movement of the packer 34 with respect to the base pipe 36 in both an axial direction and a rotational direction.

By way of example, each wedge member 76 may have a cross-sectional shape with a hump or curved portion 78 received in a corresponding recess 80 formed in the interior surface of the corresponding collar 46. Additionally, the interior of each wedge member 76 may comprise gripping features 82 oriented to grip into base pipe 36 once the collar 46 is suitably plastically deformed in a radially inward direction. Similar to other embodiments described herein, the wedge members 76 create an interference between the base pipe 36 and the packer 34. However, the orientation of wedge members 76 serve to create interference in both axial and rotational directions.

Figure 14:
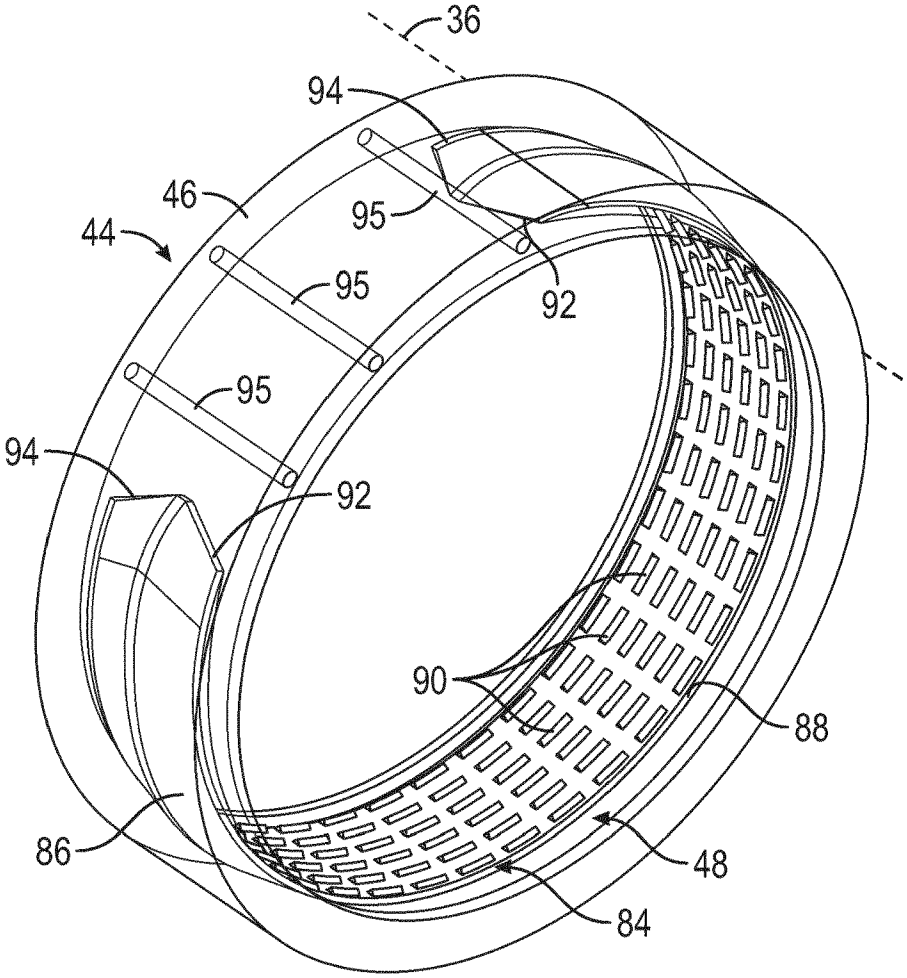
FIG. 14 is an illustration of the annular ring disposed within a corresponding extremity, according to an embodiment of the disclosure.
Figure 13:
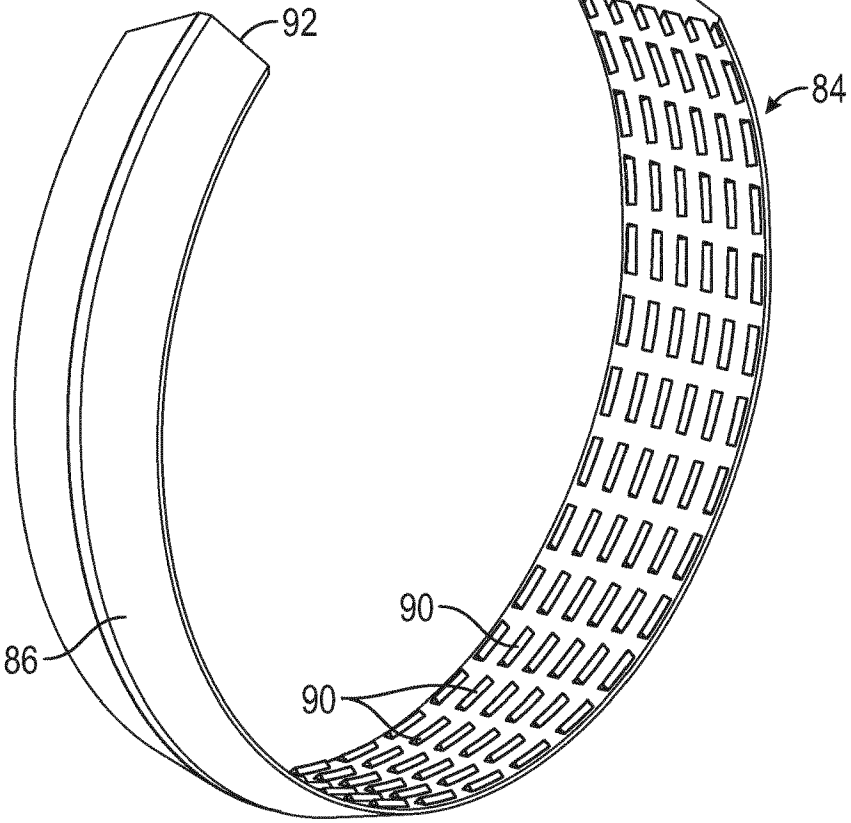
FIG. 13 is an illustration of an annular ring which can be utilized in another example of the anchoring system, according to an embodiment of the disclosure.

Referring generally to FIGS. 13 and 14, another embodiment of anchoring system 48 is illustrated. In this example, the anchoring system 48 comprises an annular ring 84, e.g. a split annular ring, having a cross-sectional cone shape (or other suitable shape) to create a cone shaped portion 86 received in a corresponding recess 88. In some embodiments, the corresponding recess 88 may be formed in the interior surface of the corresponding collar 46 along a portion of the circumference of the interior surface. Additionally, the interior of annular ring 84 may comprise gripping features 90 oriented to grip into base pipe 36 once the collar 46 is suitably plastically deformed in a radially inward direction.

The annular ring 84 may extend circumferentially along the corresponding recess 88, e.g. groove, formed along a portion of the interior of the corresponding collar 46. The annular ring 84 also comprises ends 92. The ring ends 92 are located adjacent interference portions 94 of collar 46 at the ends of recess 88 to prevent movement of annular ring 84 along the recess/groove 88 (see FIG. 14). Thus, when the collar 46 of the corresponding extremity 44 is crimped radially inward into engagement with base pipe 36, the gripping features 90 engage base pipe 36 and cooperate with the cone shaped portion 86 to prevent sliding axial movement of the packer 34 with respect to the base pipe 36. It should be noted some embodiments may route hydraulic lines 95 between ends 92, e.g. hydraulic lines for connecting the packer body to an expansion valve system.

Furthermore, once the collar 46 is suitably plastically deformed in the radially inward direction, the ring ends 92 of split annular ring 84 prevent relative rotation of the packer 34 with respect to the base pipe 36 via interfering engagement with interference members 94 (as the base pipe 36 is gripped via gripping features 90). In this manner, the annular ring 84 serves as both the axial mechanism 50 and rotational mechanism 52.

Figure 16:
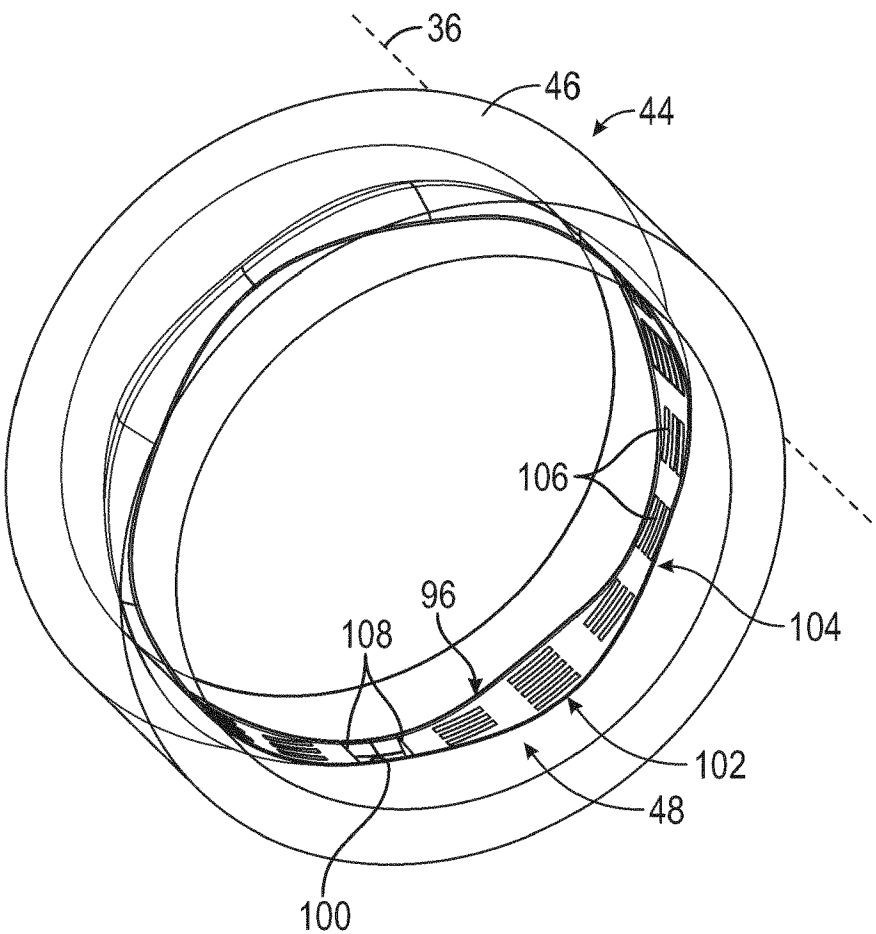
FIG. 16 is an illustration of the waved annular ring disposed within a corresponding extremity, according to an embodiment of the disclosure.
Figure 15:
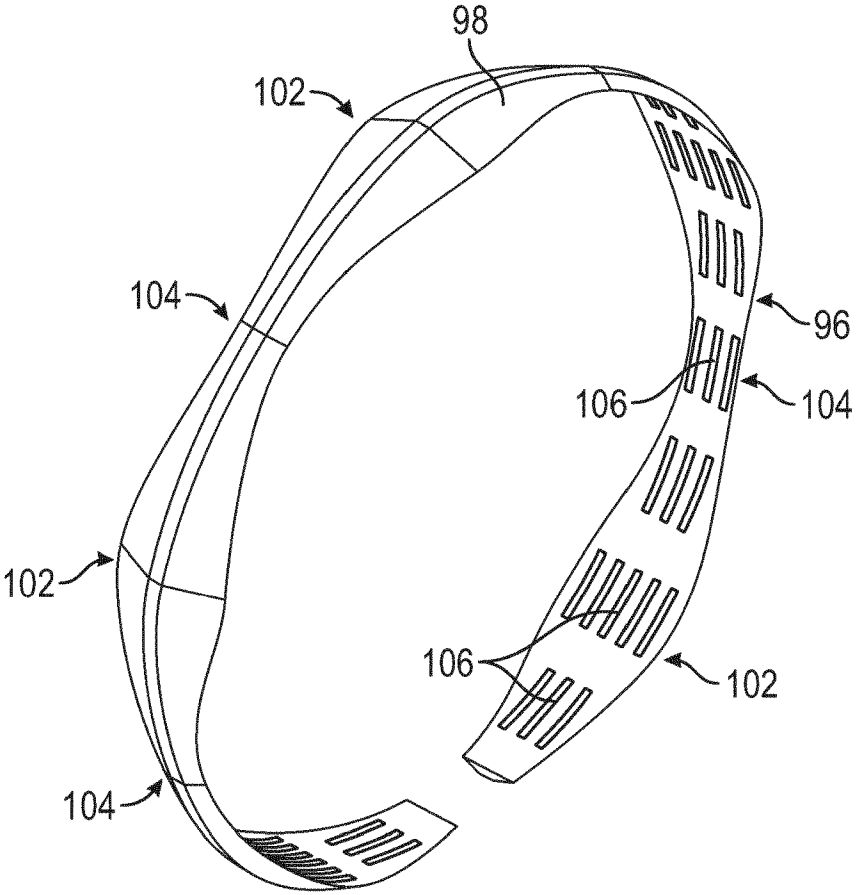
FIG. 15 is an illustration of a waved annular ring which can be utilized in another example of the anchoring system, according to an embodiment of the disclosure.

Referring generally to FIGS. 15 and 16, another embodiment of anchoring system 48 is illustrated. In this example, anchoring system 48 comprises a waved annular ring 96 having a cross-sectional shape with a hump or curved portion 98 received in a corresponding recess 100 formed in the interior surface of the corresponding collar 46. However, the sides of the waved annular ring 96 are shaped in an undulating or waved pattern such that the ring 96 has axially wide sections 102 and axially narrow sections 104. The size of the hump or curved section 98 is thus greater in the axially wide sections 102 and smaller in the axially narrow sections 104. The corresponding recess 100 may be formed with a similar or matching waved pattern.

Additionally, the interior of waved annular ring 96 may comprise gripping features 106 oriented to grip into base pipe 36 once the collar 46 is suitably plastically deformed in a radially inward direction. The waved annular ring 96 may extend circumferentially along the corresponding recess 100 formed in the interior of the corresponding collar 46. For example, the waved annular ring 96 may extend circumferentially along a portion of the interior of the corresponding collar 46 between ring ends 108, as illustrated in FIG. 16.

When the collar 46 of the corresponding extremity 44 is crimped radially inward into engagement with base pipe 36, the gripping features 106 engage base pipe 36 and cooperate with the hump or curved portion 98 to prevent sliding axial movement of the packer 34 with respect to the base pipe 36. Once the collar 46 is suitably plastically deformed in the radially inward direction, the gripping features 106 and the larger humps of axially wide sections 102 prevent relative rotation of the packer 34 with respect to the base pipe 36. In other words, the larger humps of axially wide sections 102 create an interfering engagement with the corresponding collar 46 to prevent rotation of the collar 46 (thus preventing rotation of the packer 34) with respect to the base pipe 36. In this manner, the waved annular ring 96 effectively serves as the axial mechanism 50 and the rotational mechanism 52.

Figure 17:
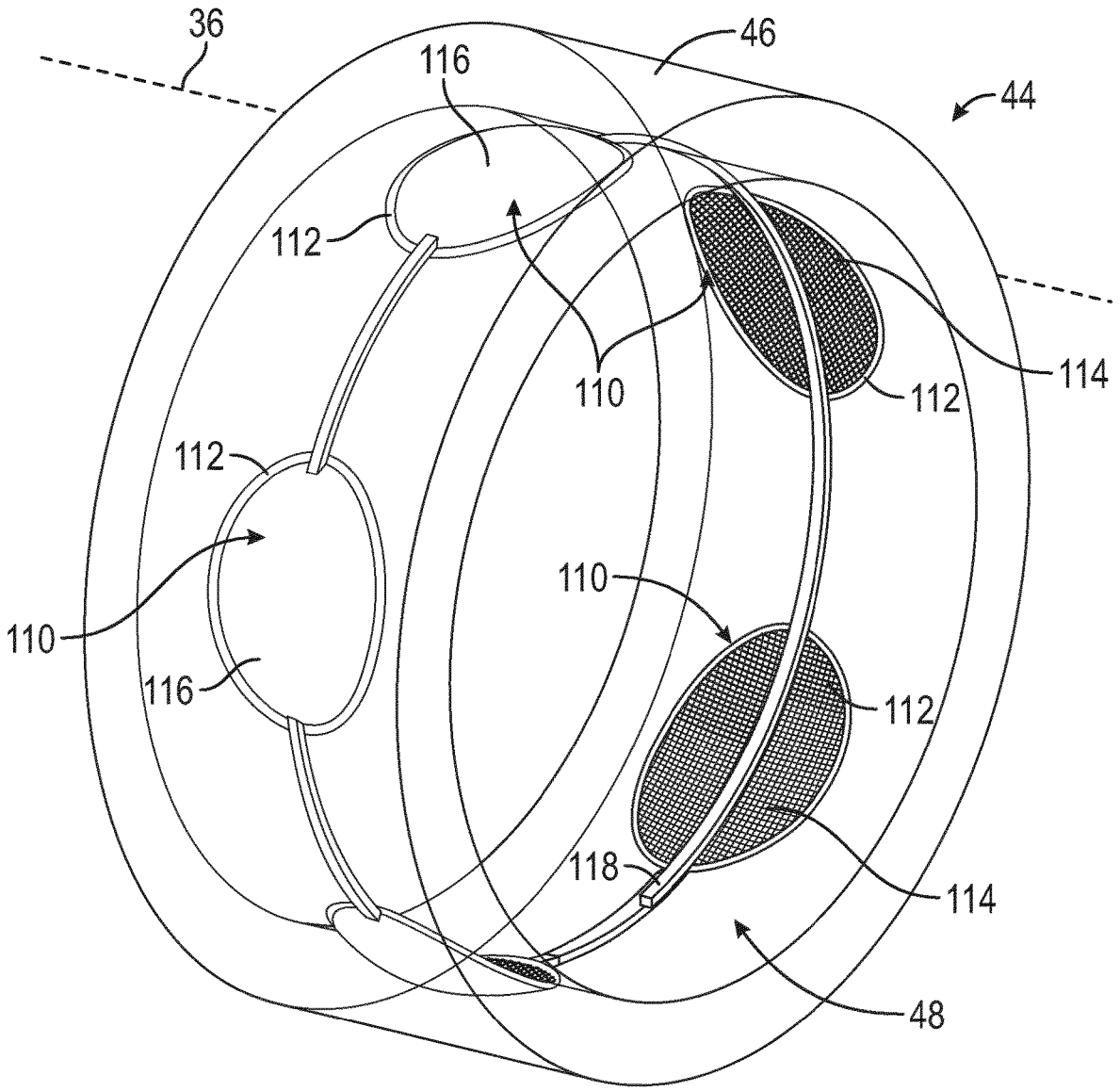
FIG. 17 is an illustration of another example of the anchoring system disposed within a corresponding extremity, according to an embodiment of the disclosure.

Referring generally to FIG. 17, another embodiment of anchoring system 48 is illustrated. In this example, the axial mechanism 50 and rotational mechanism 52 are again combined in the form of a plurality of dome-shaped members 110 disposed between the collar 46 and the base pipe 36. For example, the plurality of dome-shaped members 110 may be positioned within corresponding dome recesses 112 formed in collar 46 of the corresponding extremity 44.

The dome-shaped members 110 each have a gripping side with rotational gripping features 114 oriented toward base pipe 36 for engagement with base pipe 36 when the corresponding collar 46 is plastically deformed in an inward direction. Each dome-shaped member 110 also has a curved side 116, e.g. domed side, disposed in the corresponding recess 112 and oriented against the corresponding collar 46/extremity 44. Placement of dome-shaped members 110 in corresponding recesses 112 effectively creates interference between the base pipe 36 and the collar 46/packer 34 in both an axial direction and a rotational direction. As illustrated, a retention member 118, e.g. a spring or a split ring, may be used to initially maintain the dome-shaped members 110 in their corresponding recesses 112 prior to the plastic deformation.

When the collar 46 of the corresponding extremity 44 is crimped radially inward into engagement with base pipe 36, the gripping features 114 of each dome-shaped member 110 engage base pipe 36 and cooperate with the domed side 116 to prevent sliding axial movement of the packer 34 with respect to the base pipe 36. Furthermore, once the collar 46 is suitably plastically deformed in the radially inward direction, the gripping features 114 and the domed side 116 also prevent relative rotation of the packer 34 with respect to the base pipe 36. In other words, the dome-shaped members 110 create an interfering engagement with the corresponding collar 46 to prevent rotation of the collar 46 and overall packer 34 with respect to the base pipe 36. In this manner, the dome-shaped members 110 serve as both the axial mechanism 50 and the rotational mechanism 52.

Depending on the characteristics of a given application and environment, well system 30 may have many types of configurations. For example, the well system 30 may utilize tubing string 38 in the form of a casing while drilling string or other suitable tubing string used in high torque load applications. Additionally, the expandable metal packer 34 may be employed as an isolation device in a variety of operations and environments which may be subjected to high differential pressures. For example, the expandable metal packer 34 may be used in well applications and in other applications in which isolation between sections of a tubular structure is desired. The expandable metal packer 34 may be constructed with various types and sizes of expandable metal sleeves 40 depending on the parameters of a given operation. In a variety of well applications, the expandable metal sleeve 40 may be formed from a plastically deformable metal membrane, bladder, or other metal structure which may be radially expanded via fluid pressure.

Similarly, the anchoring system 48 may have various configurations and may be located between one of the extremities 44 and the base pipe 36 or between both extremities 44 and the base pipe 36. Additionally, the expandable metal sleeve 40 may be secured to extremities 44 via a variety of techniques, including threaded engagement, welding, combined seals and fasteners, crimping, and/or other suitable coupling techniques. The anchoring system 48 also may utilize features of various sizes and configurations to create interference between the packer 34 and the base pipe 36 so as to prevent relative rotation of the packer 34 with respect to the base pipe 36.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a tubing string having a base pipe;

an expandable metal packer mounted around the base pipe and having an expandable metal sleeve operatively anchored along the base pipe via a pair of extremities and an anchoring system, the anchoring system being positioned between at least one of the extremities and the base pipe to prevent axial sliding of the expandable metal packer with respect to the base pipe and to prevent rotational movement of the expandable metal packer with respect to the base pipe via interference;

wherein the anchoring system comprises a pad having a gripping side oriented against the base pipe and a curved side oriented against the corresponding extremity to create interference via a wedge effect to thus prevent rotational movement of the expandable metal packer with respect to the base pipe; and;

wherein the pad comprises a plurality of pads mounted between each extremity and the base pipe.

2. The system as recited in claim 1, wherein the anchoring system is positioned between each of the extremities and the base pipe.

3. The system as recited in claim 1, wherein each extremity is crimped against the base pipe.

4. The system as recited in claim 1, wherein the anchoring system comprises an annular ring positioned to create interference between the base pipe and a corresponding extremity of the pair of extremities to prevent axial movement of the expandable metal packer with respect to the base pipe.

5. The system as recited in claim 1, wherein the tubing string comprises a drilling string.

6. A system, comprising:

a packer having an expandable metal sleeve which is selectively expandable to maintain a seal with a surrounding surface, the expandable metal sleeve being combined with an extremity located at each axial end of the metal sleeve and an anchoring system, the anchoring system having at least one insert positioned between the extremities and a base pipe disposed within the packer, the at least one insert creating interference between the packer and the base pipe in both axial and rotational directions; and wherein the anchoring system comprises a plurality of axial movement prevention rings and a plurality of pads, each pad having a gripping side oriented against the base pipe and a curved side oriented against the corresponding extremity to create interference via a wedge effect and to thus prevent rotational movement of the packer with respect to the base pipe.

7. The system as recited in claim 6, further comprising a drill string deployed in a wellbore, the base pipe being part of the drill string.

8. A method, comprising:

providing a packer with an expandable metal sleeve positioned between extremities;

positioning the packer along a base pipe of a tubing string;

ensuring appropriate location of an anchoring system between the extremities and the base pipe; and plastically deforming the extremities to engage the anchoring system with the base pipe and with an interior of the extremities to prevent axial and rotational movement of the packer with respect to the base pipe; and wherein the anchoring system comprises a plurality of axial movement prevention rings and a plurality of pads, each pad having a gripping side oriented against the base pipe and a curved side oriented against the corresponding extremity to create interference via a wedge effect and to thus prevent rotational movement of the packer with respect to the base pipe.

9. The method as recited in claim 8, further comprising deploying the packer downhole into a borehole and expanding the expandable metal sleeve to maintain a sealing engagement with a surrounding wellbore wall.

* * * * *